US006303868B1

(12) United States Patent
Kawai

(10) Patent No.: US 6,303,868 B1
(45) Date of Patent: Oct. 16, 2001

(54) WIRE CONDUCTOR FOR HARNESS

(75) Inventor: Satoru Kawai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/491,041

(22) Filed: Jan. 25, 2000

(30) Foreign Application Priority Data

Feb. 4, 1999 (JP) ..... 11-027692

(51) Int. Cl.[7] ..... H01B 5/10
(52) U.S. Cl. ..... 174/128.1
(58) Field of Search ..... 174/126.1, 126.2, 174/128.1, 128.2, 113 R

(56) References Cited

U.S. PATENT DOCUMENTS

| | | | | |
|---|---|---|---|---|
| 3,131,469 | * | 5/1964 | Glaze | 174/128.1 |
| 4,039,743 | * | 8/1977 | Gommans | 174/128.1 X |
| 4,689,444 | * | 8/1987 | Burgess | 174/128.1 |
| 4,734,545 | * | 3/1988 | Suzuki et al. | 174/120 SR |
| 5,216,205 | * | 6/1993 | Fujii et al. | 174/128.1 |
| 6,103,976 | * | 8/2000 | Kobayashi et al. | 174/113 R |

FOREIGN PATENT DOCUMENTS

| | | |
|---|---|---|
| 60-30043 | 7/1985 | (JP) . |
| 3-184210 | 8/1991 | (JP) . |
| 3-54801 | 8/1991 | (JP) . |
| 5-266719 | 10/1993 | (JP) . |
| 8-124420 | 5/1996 | (JP) . |

* cited by examiner

*Primary Examiner*—Chau N. Nguyen
(74) *Attorney, Agent, or Firm*—Burr & Brown

(57) ABSTRACT

A wire conductor for a wiring harness includes a stranded wire obtained by twisting strands around a core wire. The core wire is composed of beryllium copper and the strands twisted around the core wire are composed of annealed copper. Preferably, the wire conductor includes a stranded wire obtained by twisting 6, 12 or 18 strands around the core wire. Half of the strands twisted around the core wire are composed of beryllium copper, the remaining strands and the core wire are composed of annealed copper, and the strands composed of beryllium copper and the strands composed of annealed copper are alternately arranged around the core wire. The wire conductor has sufficient conductivity and strength, causes no disconnection even when produced in a small diameter, and has appropriate flexibility.

6 Claims, 2 Drawing Sheets

WIRE CONDUCTOR FOR HARNESS

BACKGROUND OF THE INVENTION AND RELATED ART STATEMENT

The present invention relates to a wire conductor for a wiring harness usable, for example, in electrical connections between electric or electronic appliances or inside such appliances, or in a wiring harness of an automobile.

For example, in electrical connections between electric or electronic appliances or inside such appliances, or in a wiring harness for an automobile, there is used a wire conductor 1 for the harness, comprising (1) a stranded wire 5 obtained by twisting strands 3 around a core wire 2 and (2) an insulator cord (e.g. a polyvinyl chloride) or the like covering the stranded wire 5, such as shown in FIG. 2(*a*) or 2(*b*) [in FIG. 2(*b*), the insulator cord is not shown for simplicity]. As mentioned above, the wire conductor 1 for the harness is produced by twisting the strands 3 around the core wire 2; therefore, the harness has flexibility and, compared to a single strand having the same cross-sectional area used to achieve the same conductivity, can be easily bent in wiring or the like without causing disconnection. Therefore, the wire conductor 1 for the harness is suitably used when many wirings are needed in a small space as in the case of (1) wiring in the control circuit of electric or electronic appliances or automobiles or (2) electrical connection between various appliances. Annealed copper has been mainly used as the conducting wires used in wire conductors for the harness.

In recent years, control circuits of increased number have come to be required in electric or electronic appliances and automobiles because the appliances and automobiles exhibit higher performance; control circuits of smaller size have come to be required in the above appliances and automobiles because the appliances and automobiles have become smaller in size; and also, because, smaller weights have come to be required for automobiles from the standpoint of energy savings. For these reasons, it is desirable that the wire conductor for the harness is made lighter, and can be produced in a smaller diameter and bent more easily so as to allow wiring in a smaller space. Conducting wires composed of annealed copper have insufficient strength although they have more than sufficient conductivity. Therefore, in order to produce a wire conductor for a harness having appropriate strength by using such conductive wires, it has been inevitable that the wire conductor for the harness have the same diameter as that employed in conventional wire conductors for the harness.

Hence, in order to produce a wire conductor for a harness of lighter weight and smaller diameter, for example, JP-B-60-30043 and JP-A-5-266719 disclose a wire conductor for a harness obtained by twisting strands composed of a copper alloy such as Sn—Cu, Cr—Cu or the like. Also, JP-A-03-184210 discloses a wire conductor for a harness obtained by twisting strands whose center is composed of an alloy containing steel as a main component and whose periphery is composed of copper or a copper alloy. Also, JP-A-08-124420 discloses a wire conductor for harness obtained by twisting reinforced fine copper wires containing finely dispersed reinforcing aluminum. Further, JP-A-60-150502 mentions on a wire conductor obtained by twisting strands having a center composed of a copper alloy such as beryllium copper or the like and whose periphery is composed of pure copper such as electrolytic copper, oxygen-free copper, deoxidized copper or the like.

These wire conductors, however, have had problems. The wire conductor using a Sn—Cu alloy has insufficient conductivity and strength and is difficult to use if it has a cross-sectional area of 0.2 $mm^2$ or less. The Cr—Cu alloy does not have sufficient tensile strength and ductility and accordingly has insufficient strength; moreover, when, as shown in FIG. 3, the end of a wire conductor 1 is held by a terminal 6 or the like, in order to connect the end of the wire conductor 1 with the terminal 6 or the like, the contact between the wire conductor 1 and the terminal 6 is bad because the Cr—Cu alloy has high hardness and low flexibility. The wire conductor whose center is composed of an alloy containing steel as a main component has a sufficient strength; however, since substantially no electricity flows in the steel portion of large resistance, no desired conductivity is obtained when the wire conductor is produced in a small diameter.

The wire conductor using reinforced fine copper wires containing finely dispersed reinforcing aluminum, and the wire conductor obtained by twisting strands whose center is composed of a copper alloy and whose periphery is composed of pure copper, are desired to have, when used in automobiles, a higher strength than when used as a wire conductor for a wiring harness, to achieve a lighter weight and a lower fuel consumption.

SUMMARY OF THE INVENTION

In view of the above situation, the present invention has an object of providing a wire conductor for a wiring harness which has sufficient conductivity and strength, which causes no disconnection even when made in a small diameter, and which has appropriate flexibility.

According to the present invention, there is provided a wire conductor for a wiring harness, comprising a stranded wire obtained by twisting strands around a core wire, wherein the core wire is composed of beryllium copper and the strands twisted around the core wire are composed of annealed copper.

In the above wire conductor for a wiring harness, the number of the strands twisted around the core wire is preferably 6, 12 or 18.

According to the present invention, there is further provided a wire conductor for a wiring harness, comprising a stranded wire obtained by twisting 6, 12 or 18 strands around a core wire, wherein half of the strands twisted around the core wire are composed of beryllium copper, the remaining strands and the core wire are composed of annealed copper, and the strands composed of beryllium copper and the strands composed of annealed copper are alternately arranged around the core wire.

In the wire conductor according to the present invention, each of the core wire and the strands twisted around the core wire, preferably has a diameter of 0.1 to 1.0 mm.

BRIEF DESCRIPTION OF THE DRAWINGS

FIG. 1(*a*) is an example, and FIG. 1(*b*) is another example.

DESCRIPTION OF PREFERRED EMBODIMENTS

Figure 1:
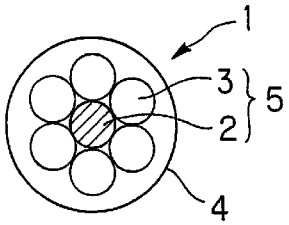
FIGS. 1(*a*)(*b*) are cross-sectional views showing the wire conductor for harness according to the present invention.
Figure 1:
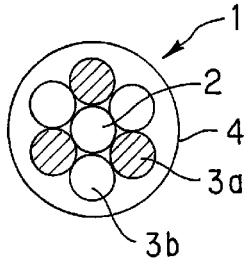
Figure 2:
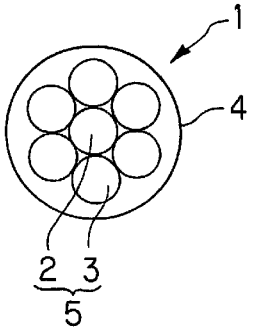
FIG. 2(*a*) is a cross-sectional view showing the ordinary constitution of a wire conductor for harness, and FIG. 2(*b*) is a schematic view showing the stranded wire constituting the wire conductor for harness.
Figure 2:
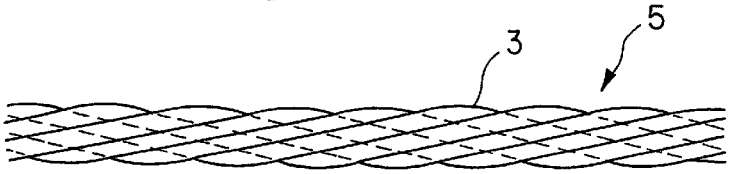

The wire conductor for a wiring harness according to the present invention, as shown in FIG. 1(*a*), comprises a stranded wire 5 obtained by twisting strands 3 around a core wire 2, wherein the core wire 2 is composed of beryllium copper and the strands 3 twisted around the core wire 2 are composed of annealed copper. Alternatively, as shown in FIG. 1(*b*), the wire conductor comprises a stranded wire 5 obtained by twisting 6, 12 or 18 strands 3 around a core wire 2, wherein half of the strands 3 twisted around the core wire 2 are composed of beryllium copper, the remaining strands 3 and the core wire 2 are composed of annealed copper, and the strands 3*a* composed of beryllium copper and the strands 3*b* composed of annealed copper are alternately arranged around the core wire 2.

Figure 4:
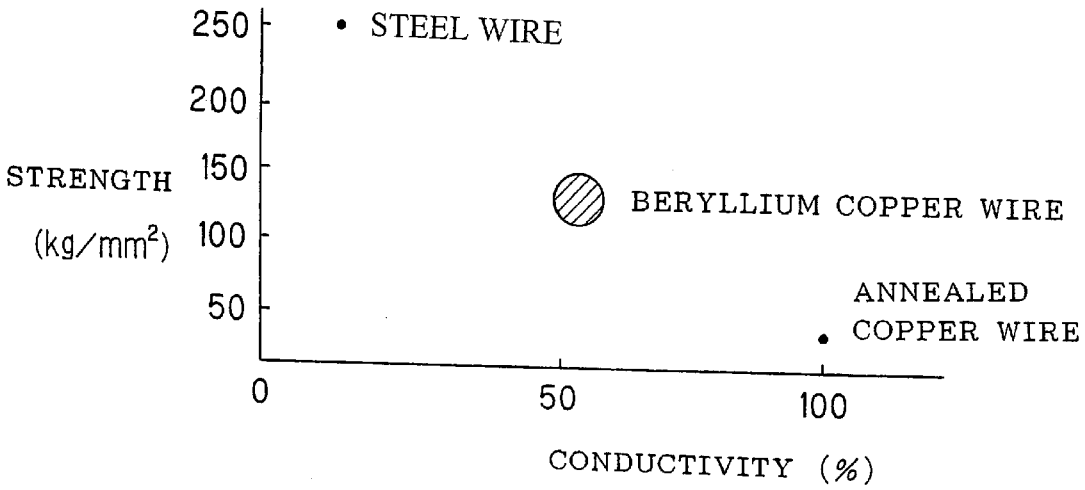
FIG. 4 is a graph showing the strength and conductivity of beryllium copper.

In the wire conductor according to the present invention, some of the conducting wires are composed of beryllium copper for the following reason. As shown in FIG. 4 (wherein conductivity is expressed as a percentage when the conductivity of annealed copper is taken as 100%), beryllium copper is almost in the middle of annealed copper wire and steel wire, in strength and conductivity; therefore, by using beryllium copper in part of the conducting wires, a current flows also in the beryllium copper wires unlike the case of using steel and it is possible to allow the wire conductor to have good conductivity and high strength.

Specifically, an annealed copper wire generally has a strength of 20 kg/mm$^2$ while a beryllium copper wire of the same diameter has a strength of 60 to 150 kg/mm$^2$. When the conductivity of a wire conductor for a wiring harness using annealed copper in all the conducting wires is taken as 100%, the conductivity of, for example, a wire conductor for a wiring harness shown in FIG. 1(*a*), using beryllium copper only in the core wire is 90%. Therefore, the strength of the wire conductor can be made high without substantially impairing the conductivity and, even if the wire conductor is made in a small diameter, it can have a sufficient strength. That is, in a wire conductor for a wiring harness using annealed copper alone, the smallest diameter of each conducting wire was 0.26 mm for achieving necessary strength; however, by using beryllium copper as part of the conducting wires, the diameter of each conducting wire can be made as small as 0.1 mm while keeping necessary strength. Therefore, by using the wire conductor for a wiring harness according to the present invention, the requirement for a smaller control circuit, associated with the movement toward smaller electric appliances, can be satisfied and wiring in smaller space is made possible.

By using beryllium copper, the wire conductor can be made in a small diameter and accordingly is lighter in weight. Annealed copper has a specific gravity of 8.89 and, in contrast, beryllium copper has a smaller specific gravity of 8.26; therefore, use of beryllium copper can make the wire conductor for a wiring harness even lighter. Specifically, when the weight of a wire conductor for a wiring harness using only annealed copper wires, each of 0.26 mm in diameter, is taken as 100, the weight of a wire conductor for harness of FIG. 1(*a*) using conducting wires each of 0.19 mm in diameter is 53 which is lighter than 100 by 47%. Thus, the wire conductor for a wiring harness according to the present invention can well respond to the requirement of, for example, lighter automobiles.

Making the wire conductor finer results in increased electric resistance. In conventional wire conductors using annealed copper alone, the conductivity is higher than necessary in order to secure a necessary strength. Therefore, in wire conductors used in applications (e.g. control circuit) where a large amount of electricity is not required, slight sacrifice of conductivity by making the wire conductor finer presents no practical problem.

Figure 3:
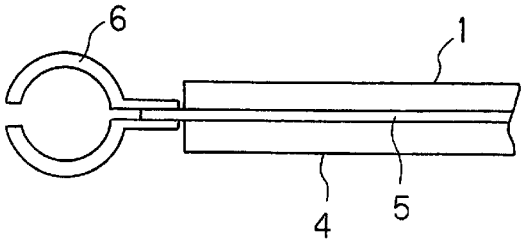
FIG. 3 is a schematic view showing a connection area between one end of a wire conductor for harness and a terminal.

The wire conductor according to the present invention uses beryllium copper in part of the conducting wires and has appropriate flexibility; therefore, when, as shown in FIG. 3, the end of a wire conductor 1 is held by a terminal 6 or the like to connect the end of the wire conductor 1 with the terminal 6 or the like, caulking appears and good contact can be obtained.

In the present invention, part of the conducting wires are composed of beryllium copper alone. The reason is that use of beryllium copper in all of the conducting wires makes the resistance of the wire conductor too high for a wiring harness, reduces the flexibility of wire conductor for a wiring harness, and makes the wire conductor for a wiring harness unsuitable for control circuits, etc.

In the wire conductor according to the present invention, each of the core wire and the strands twisted around the core wire has a diameter of preferably 0.1 to 1.0 mm, more preferably 0.1 to 0.6 mm, further preferably 0.1 to 0.3 mm. When the diameter is smaller than 0.1 mm, the wire conductor has too large a resistance and very low strength. When the diameter is larger than 1.0 mm, the wire conductor has very low flexibility, making wiring difficult.

In the wire conductor shown in FIG. 1(*a*), according to the present invention, the core wire is composed of beryllium copper. The reason is to obtain an increased strength and allow even the core wire to have certain conductivity. In the wire conductor for a wiring harness shown in FIG. 1(*b*), according to the present invention, the strands composed of beryllium copper and the strands composed of annealed copper are alternately arranged around the core wire. The reason is to reduce the cross-sectional area (consequently, the weight) of the wire conductor.

In the wire conductor according to the present invention, the number of the strands provided around the core wire is preferably 6, 12 or 18. The reason is for easier twisting.

In the wire conductor according to the present invention, it is preferred that the beryllium copper used contains copper as a main component and beryllium in a content of 0.2 to 2.0% by weight. When the content of beryllium is higher than 2.0% by weight, the wire conductor has low strength.

In the wire conductor, there is no particular restriction as to the kind of covering material used for the conducting wires as long as the covering material has flexibility and an insulating property. However, the covering material preferably has heat resistance. Preferable specific examples of the covering material are a polyvinyl chloride resin, a crosslinked vinyl resin and a crosslinked polyethylene resin.

The present invention is described in more detail below with reference to the Examples shown in the drawings. However, the present invention is in no way restricted to these Examples.

EXAMPLE 1

There was produced a wire conductor 1 for a wiring harness shown in FIG. 1(*a*), comprising a core wire 2 and six strands 3 twisted around the core wire 2. As the core wire 2, a beryllium copper 25 HT wire of 0.19 mm in diameter containing 1.60% by weight of beryllium was used. As the strands 3 twisted around the core wire 2, annealed copper wires of 0.19 mm in diameter were used. As a covering material 4, a polyvinyl chloride resin was used. The pitches of twisting the strands 3 around the core wire 2 were 30 mm. Incidentally, "beryllium copper 25 HT" refers to the H material of 25 kinds of beryllium copper, which had been subjected to age hardening.

The above wire conductor 1 for a wiring harness was measured for tensile strength and conductivity according to JIS C 3002. The results are shown in Table 1.

EXAMPLE 2

There was produced a wire conductor 1 for a wiring harness shown in FIG. 1(*b*), in the same manner as in Example 1 except that half of the strands 3 twisted around the core wire 2 were composed of beryllium copper 25 HT, the remaining strands 3 and the core wire 2 were composed of annealed copper, and the strands 3*a* composed of beryllium copper and the strands 3*b* composed of annealed copper were alternately arranged around the core wire 2. The wire conductor 1 for a wiring harness was measured for tensile strength and conductivity. The results are shown in Table 1.

Comparative Example 1

There was produced a wire conductor for a wiring harness in the same manner as in Example 1 except that the core wire and the six strands twisted around the core wire were all an annealed copper wire. The wire conductor was measured for tensile strength and conductivity. The results are shown in Table 1.

Comparative Example 2

There was produced a wire conductor for a wiring harness in the same manner as in Example 1 except that the six strands twisted around the core wire were all a beryllium copper 11 HT wire. The wire conductor was measured for tensile strength and conductivity. The results are shown in Table 1. Incidentally, "beryllium wire 11 HT" refers to the H material of 11 kinds of beryllium copper, which had been subjected to age hardening.

Comparative Example 3

Figure 5:
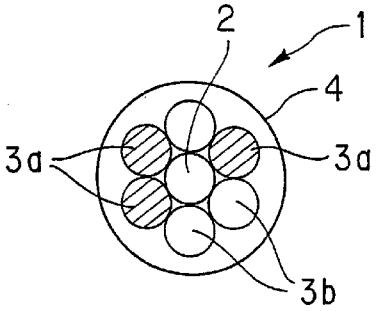
FIG. 5 is a cross-sectional view showing an example of a wire conductor for harness.

There was produced a wire conductor 1 for a wiring harness shown in FIG. 5, in the same manner as in Example 2 except that the strands 3*a* composed of beryllium copper 25 HT and the strands 3*b* composed of annealed copper were arranged around the core wire 2 but not alternately. The wire conductor for harness was measured for tensile strength and conductivity. The results are shown in Table 1.

TABLE 1

Substitute Specification Appendix B

| | Resistance per unit length (mΩ/50 cm) | Tensile strength (N) | Core wire | Strands twisted around core wire | Cross-sectional area of wire conductor for harness ($mm^2$) |
|---|---|---|---|---|---|
| Example 1 | 56.5 | 73 | Beryllium copper 25 HT wire | Annealed copper wires | 0.2 |
| Example 2 | 64.3 | 141 | Annealed copper wire | Beryllium copper 25 HT wires and the same number of annealed copper wires were arranged alternately. | 0.2 |
| Comparative Example 1 | 51.9 | 48 | Annealed copper wire | Annealed copper wires | 0.2 |
| Comparative Example 2 | 103.2 | 164 | Beryllium copper 25 HT wire | Beryllium copper 11 HT wires | 0.2 |
| Comparative Example 3 | 133.6 | 194 | Beryllium copper 11 HT wire | Beryllium copper 25 HT wires and the same number of annealed copper wires were arranged randomly. | 0.2 |

As is clear from Table 1, the wire conductors according to the Examples have sufficient tensile strength and appropriate conductivity. Meanwhile, the wire conductor according to Comparative Example 1 has appropriate conductivity but insufficient tensile strength, and the wire conductors according to Comparative Examples 2 and 3 have sufficient tensile strength but high resistance and insufficient conductivity.

The wire conductor according to the present invention has good conductivity and sufficient strength even when produced in a small diameter. Since it can be produced in a small diameter, it enables wiring in a smaller space and can respond to the requirement of smaller control circuits associated with the movement of electric appliances, etc. to smaller sizes. Therefore, the wire conductor according to the present invention can be suitably used, for example, in electrical connections between electric or electronic appliances (e.g. computer, office automation appliance, communication appliance and acoustic appliance) or inside such appliances, or in a wire harness of an automobile.

Also, being lightweight, the wire conductor for a wiring harness according to the present invention can respond well to the recent requirement of lighter automobiles. Further, since conducting wires composed of beryllium copper have appropriate flexibility, the present wire conductor exhibits good contact when it is held at the end by a terminal or the like.

What is claimed is:

1. A wire conductor for a wiring harness, comprising a stranded wire obtained by twisting strands around a core wire, wherein the core wire is composed of beryllium copper and the strands twisted around the core wire are composed of annealed copper.

2. A wire conductor for a wiring harness according to claim 1, wherein the number of the strands twisted around the core wire is 6, 12 or 18.

3. A wire conductor for a wiring harness according to claim 2, wherein each of the core wire and the strands twisted around the core wire has a diameter of 0.1 to 1.0 mm.

4. A wire conductor for a wiring harness according to claim 1, wherein each of the core wire and the strands twisted around the core wire has a diameter of 0.1 to 1.0 mm.

5. A wire conductor for a wiring harness, comprising a stranded wire obtained by twisting 6, 12 or 18 strands around a core wire, wherein half of the strands twisted around the core wire are composed of beryllium copper, the remaining strands and the core wire are composed of annealed copper, and the strands composed of beryllium copper and the strands composed of annealed copper are alternately arranged around the core wire.

6. A wire conductor for a wiring harness according to claim 5, wherein each of the core wire and the strands twisted around the core wire has a diameter of 0.1 to 1.0 mm.

* * * * *